United States Patent [19]

Cordell, Jr.

[11] 4,318,505

[45] Mar. 9, 1982

[54] DISPOSABLE SUITCASE

[76] Inventor: Charles E. Cordell, Jr., P.O. Box A, El Cajon, Calif. 92020

[21] Appl. No.: 177,484

[22] Filed: Aug. 12, 1980

[51] Int. Cl.[3] ..... B65D 5/46

[52] U.S. Cl. ..... 229/52 B; 229/DIG. 6

[58] Field of Search ..... 229/52 B, 6 R, 16 R, 229/24, 25, 26, DIG. 6

[56] References Cited

U.S. PATENT DOCUMENTS 1,135,742 4/1915 Voris ..... 229/31 R
1,501,134 7/1924 Osburn ..... 229/16 R
2,252,023 8/1941 Mulnix ..... 229/41 B
3,269,637 8/1966 Wittaker ..... 229/41 B

FOREIGN PATENT DOCUMENTS 779798 3/1968 Canada ..... 229/52 B

*Primary Examiner*—Herbert F. Ross
*Attorney, Agent, or Firm*—Henri J. A. Charmasson

[57] ABSTRACT

A portable suitcase is provided conviently die cut from a single sheet of material such as corrugated fiberboard and preferably scored to be foldable in a tightly locked box configuration.

4 Claims, 7 Drawing Figures

FIG. 1
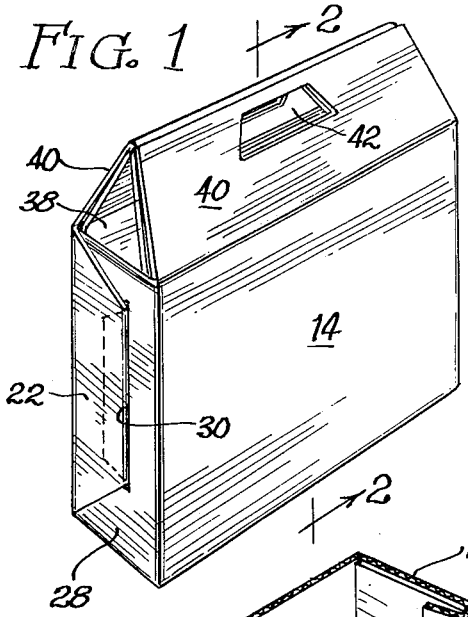
FIG. 2
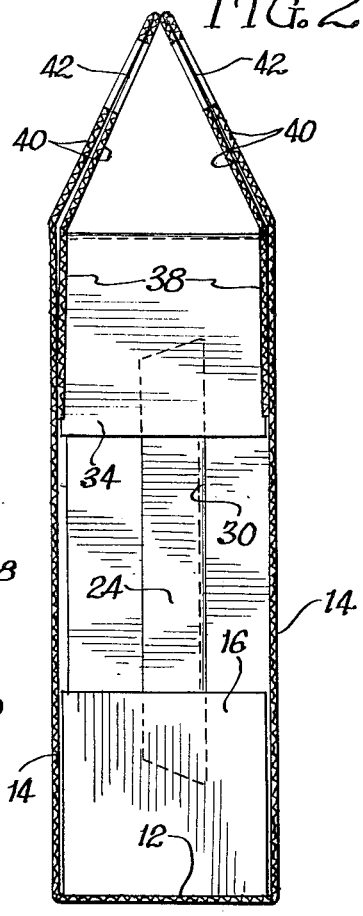
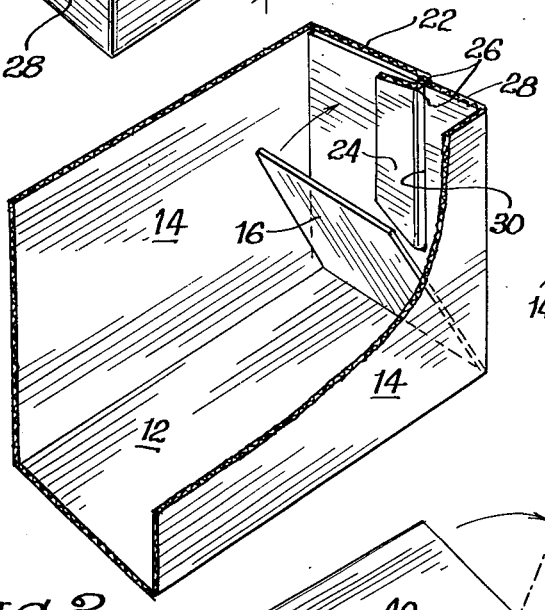
FIG. 3
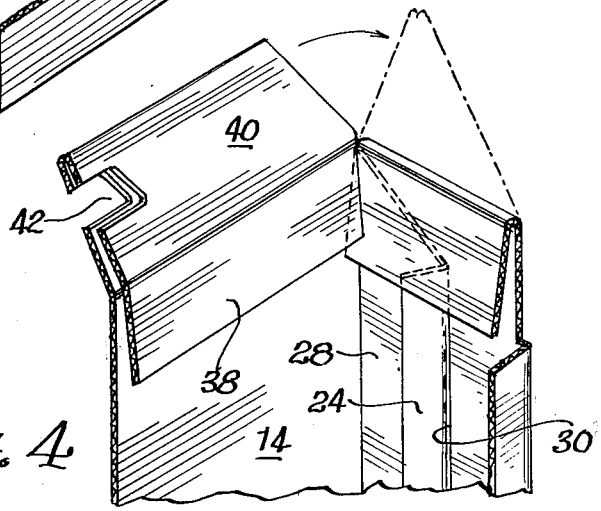
FIG. 4

DISPOSABLE SUITCASE

BACKGROUND

Very often when traveling, especially if the traveler is unseasoned, inadequate luggage space is provided for handling the volume of merchandise purchased in foreign ports to be taken home. The items purchased often find their way home in dilapidated paper bags, plastic shopping bags and a multiplicity of other unsuitable containers which lead to the spilling of the contents and possibly damage to the merchandise.

Although the logical thing to do would be to carry an extra suitcase or two, naturally no one wants to burden themselves with an empty suitcase throughout half or three quarters of the trip. Thus the dilemma of providing a suitable way to return home with subsequently acquired merchandise heretofore has had no logical solution.

SUMMARY

The present invention provides a solution by the introduction of an extremely simple constructed suitcase which can be shipped and stored flat but is very simply assembled into a strong and durable hand carried suitcase.

Although the unit is durable enough to withstand several trips at the least, it can be made so inexpensively that the purchaser would have no qualms about disposing of it after a single use and would not be put to the financial burden of purchasing an additional, perhaps unneeded suitcase along with other items to be imported home.

DETAILED DESCRIPTION OF THE DRAWINGS

FIG. 1 is a perspective view of the suitcase assembled;

FIG. 2 is a section taken along Line 2—2 of FIG. 1;

FIG. 3 is a perspective view of a detail of construction of the suitcase while the bottom panel endflap is being swung into place;

FIG. 4 is a perspective view of another detail;

DETAILED DESCRIPTION OF THE PREFERRED EMBODIMENT

Figure 5:
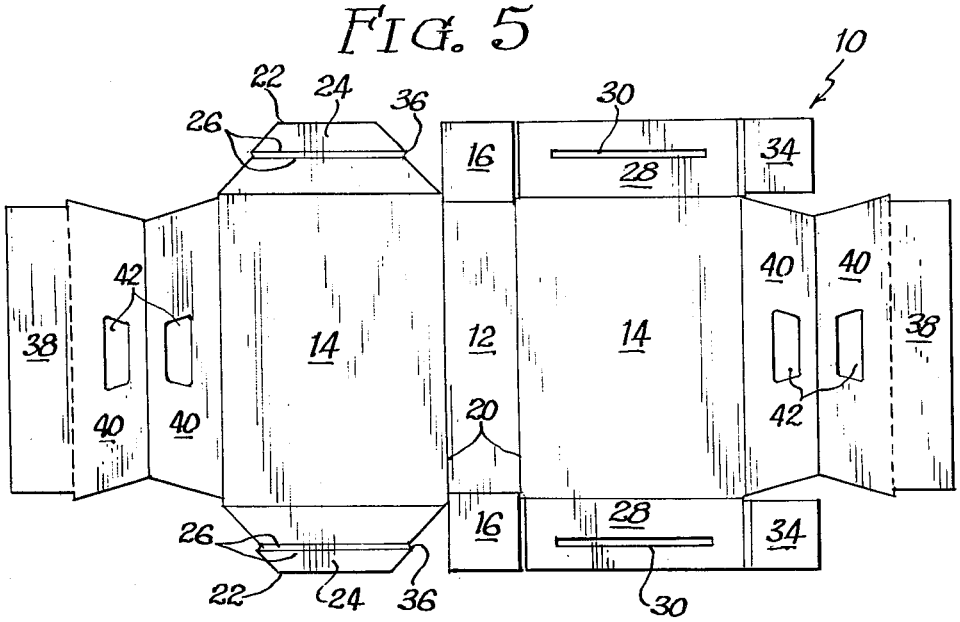
FIG. 5 is a plan view of the suitcase in its original unitary die cut piece.
Figure 6:
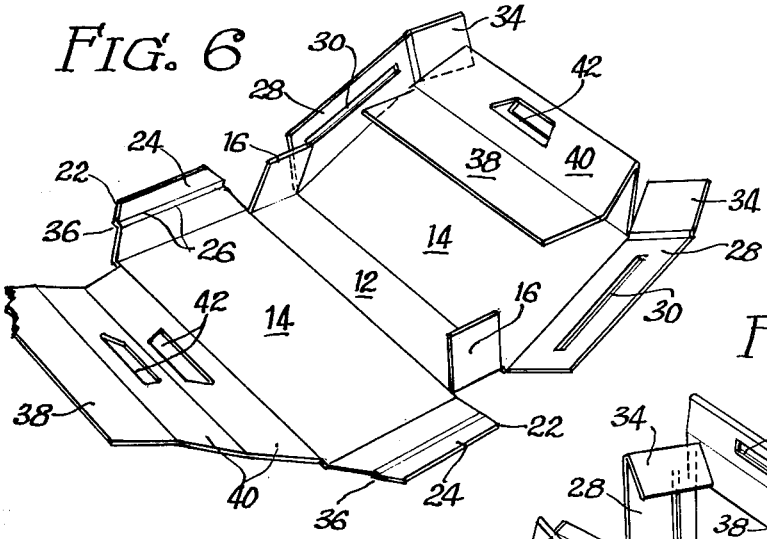
FIG. 6 is a perspective view of the unitary piece of FIG. 5 being folded.
Figure 7:
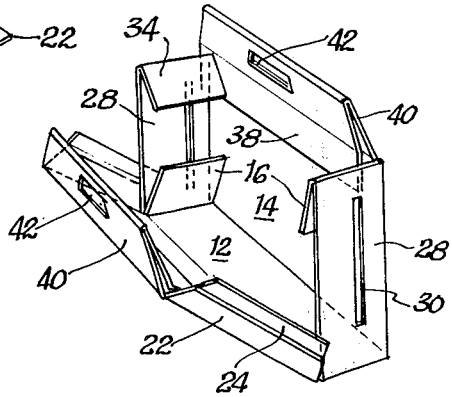
FIG. 7 is a perspective view of the suitcase of FIG. 6 at a further stage of assembly.

Construction of the suitcase is best understood by initial reference to FIGS. 5 through 7 which indicate the shape of the die cut and the way in which it is folded to assemble the suitcase.

The die cut 10 has a bottom panel 12 with end tabs 16 and a pair of oppositely directed side directed side panels 14 which, as can best be seen in FIG. 5, are slightly longer at their junction lines with the bottom panel 12 to accommodate the various flaps and tabs which are folded together in the final construction.

Preferably the junction lines between all panels, flaps and tabs are scored as at 20 and double scored where a reverse bend is required such as where end flaps 22 are joined to their extending tongues 24 at 26.

The other one of the side panels 14 is provided with end panels 28 which have elongated slots 30 therein and end panel tabs 34 extending from the top edge.

Assembly of the structure from its flat die cut form of FIG. 5 indicated at 10 into a suitcase begins with the bending upwardly of the bottom panel end tabs 16 and the side panels 18 as shown in FIG. 7. As the side panels are bent into the vertical position at their score lines, end flaps 22 are inserted through the slots 30 into the end panels 28 of the opposite side wall, with the extending tongue portions 24 of the end tabs being reverse bent as shown in FIGS. 3 and 4. It is conceivable that this construction would not involve the reverse bending of the tongue inasmuch as barbs or detents 36 are defined where the end flaps join their tongues, and these detents would ordinarily be adequate to hold the two side panels together. If the tongues are not reverse-bent, a sharp blow downward on the apex formed by the handle panels will conveniently lay the suitcase open substantially back into the configuration of FIG. 6.

In the event the tongues are rearwardly bent however, the end tabs 16 are swung vertically against them and the end panel tabs 34 are swung downwardly against them and maintained in position by the depending handle flap 38 which extends from the handle panel 40. It should be noted that the handle flap 38 is approximately coextensive with the length of the side panels so that it securely locks both of the opposite tabs 34 in position flush against the tongues 24.

Both of the handle panels and handle flaps are provided with hand grip holes 42 and as these members are brought together as shown in FIGS. 1 and 2, the suitcase is easily held by slipping the hand through all 4 of the aligned holes.

By the reverse of the above-stated procedure, the suitcase is as easily disassembled as it is assembled, and when assembled the contents will help maintain the suitcase in its proper form by exerting pressure against the tabs 16 and 34 as well as against the internal tongues 24, providing an ideal disposable vessel for a return of souvenirs and imports from an extended trip.

I claim:

1. A disposable suitcase comprising:

(a) an elongated rectangular bottom panel;

(b) first and second side panels extending from the longitudinal edges of said bottom panel;

(c) said first side panel having a pair of slotted end panels extending therefrom and foldable orthogonally thereto and said second side panels having extended end flaps foldable generally orthogonally thereto and engageable in the respective slots in said end panels;

(d) handgrip panels extending upward from the upper edges of said side panels and having hand holes therein such that when said end flaps are engaged in said slots, said handgrips can be brought together such that said holes align for carrying;

(e) said end flaps having extended tongues reverse foldable in said slots to define a positive locking mode; and (f) said bottom panel defines end tabs foldable flush against said tongue when reverse-folded to hold in place whereby said slotted end panels and flaps freeing said handgrip panels from the burden of holding said side panels together.

2. Structure according to claim 1 wherein said end panels each have upper tabs foldable downward flush against said tongues when same are reverse-folded, and said handgrip panels each have depending flaps coextensive with the length of said side panels to tuck between said upper tabs to lock same against said tongues.

3. Structure according to claim 1 wherein said end flaps include detent shoulders which lock into the respective slots.

4. Structure according to claim 1 wherein said suitcase is defined by a single sheet of corrugated fiberboard.

* * * * *